US007087268B2

(12) United States Patent
Byrne et al.

(10) Patent No.: US 7,087,268 B2
(45) Date of Patent: Aug. 8, 2006

(54) METHOD OF PLATING A GOLF CLUB HEAD

(75) Inventors: Wayne H. Byrne, Murrieta, CA (US); Herbert Reyes, Laguna Niguel, CA (US)

(73) Assignee: Callaway Golf Company, Carlsbad, CA (US)

( * ) Notice: Subject to any disclaimer, the term of this patent is extended or adjusted under 35 U.S.C. 154(b) by 136 days.

(21) Appl. No.: 10/708,896

(22) Filed: Mar. 30, 2004

(65) Prior Publication Data

US 2005/0221008 A1 Oct. 6, 2005

(51) Int. Cl.
*B05D 1/38* (2006.01)

(52) U.S. Cl. ..... 427/305; 427/304

(58) Field of Classification Search ..... 427/438, 427/304, 305

See application file for complete search history.

(56) References Cited

U.S. PATENT DOCUMENTS

| | | | | |
|---|---|---|---|---|
| 1,167,387 | A | | 1/1916 | Daniel |
| 3,887,732 | A | * | 6/1975 | Parker et al. ..... 427/380 |
| 3,989,606 | A | | 11/1976 | Kampert |
| 4,196,061 | A | | 4/1980 | Satee |
| 5,023,394 | A | * | 6/1991 | Watanabe et al. ..... 174/35 R |
| 5,131,986 | A | | 7/1992 | Harada et al. |
| 5,154,816 | A | | 10/1992 | Martinou et al. |
| 5,207,427 | A | * | 5/1993 | Saeki ..... 473/343 |
| 5,403,460 | A | | 4/1995 | Sala et al. |
| 5,494,281 | A | | 2/1996 | Chen |
| 5,531,444 | A | | 7/1996 | Buettner |
| 5,538,246 | A | * | 7/1996 | Dekura ..... 473/311 |
| 5,578,187 | A | | 11/1996 | Zitko et al. |
| 5,603,667 | A | | 2/1997 | Ezaki et al. |
| 5,643,343 | A | | 7/1997 | Selifanov et al. |
| 5,792,004 | A | | 8/1998 | Nagamoto |
| 5,851,158 | A | | 12/1998 | Winrow et al. |
| 6,193,614 | B1 | | 2/2001 | Sasamoto et al. |

OTHER PUBLICATIONS

Fairweather W.A., Electroless Nickel Plating of Magnesium, 1997, Transactions, 75, p. 113-117.*
Spencer L.F., Electroplating Magnesium Alloys-A Review, 1971, Metal Finishing, February, p. 43-46.*
PMD (UK) LTD Process Data, Ni-Shield G.*
PMD (UK) LTD Process Data, Econoclense NS.*

* cited by examiner

*Primary Examiner*—Timothy Meeks
*Assistant Examiner*—Howard Abramowitz
(74) *Attorney, Agent, or Firm*—Michael A. Catania; Elaine H. Lo

(57) ABSTRACT

A method (10 or 20) for plating a component of a golf club head (42) is disclosed herein. The component of the golf club head that is plated is preferably composed of a metal material selected from the group consisting of magnesium alloys, aluminum alloys, magnesium and aluminum. The plating (300) preferably comprises a first plating layer (302) a second plating layer (303) and a chrome or chromate layer (304). The method (10 of 20) preferably comprises exposing the component to alkaline and acidic solutions. The method (10 and 20) also preferably includes heat treating the plated component.

18 Claims, 9 Drawing Sheets

METHOD OF PLATING A GOLF CLUB HEAD

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to a method for nickel plating a component of a golf club head. More specifically, the present invention relates to a method for nickel-plating a component of a golf club head composed of a magnesium or magnesium alloy material.

2. Description of the Related Art

Magnesium alloys typically have a density ranging from 1.7 grams per cubic centimeter ("g/cm$^3$") to 1.9 g/cm$^3$. Golf club head components composed of magnesium alloys are formed through casting, metal injection molding and similar processes. However, magnesium alloys are relatively soft and easily scratched. Thus, golf club head components composed of magnesium alloys require protection from scratching and other durability problems.

Paints have so far proven ineffective in protecting golf club head components composed of magnesium alloys.

U.S. Pat. No. 5,538,246 to Dekura discloses a golf club head composed of an aluminum or magnesium alloy with a hosel attaching section.

U.S. Pat. No. 5,494,281 to Chen discloses a golf club head with a shock absorbing casing composed of a magnesium material and an elastic plate composed of an aluminum alloy.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

U.S. Pat. No. 5,603,667 to Ezaki et al., discloses an iron with a striking face composed of copper or a copper alloy and nickel plated.

U.S. Pat. No. 5,207,427 to Saeki discloses an iron with an non-electrolytic nickel-boron plating and a chromate film, and a method for manufacturing such an iron.

U.S. Pat. No. 5,792,004 to Nagamoto discloses an iron composed of a soft-iron material with a carbonized surface layer.

U.S. Pat. No. 5,131,986 to Harada et al., discloses a method for manufacturing a golf club head by electrolytic deposition of metal alloys such as nickel based alloys.

U.S. Pat. No. 6,193,614 to Sasamoto et al., discloses a golf club head with a face portion that is arranged to have its crystal grains of the material of the face portion oriented in a vertical direction. The '614 Patent also discloses nickel-plating of the face portion.

U.S. Pat. No. 5,531,444 to Buettner discloses an iron composed of a ferrous material having a titanium nitride coating for wear resistance.

U.S. Pat. No. 5,851,158 to Winrow et al., discloses a golf club head with a coating formed by a high velocity thermal spray process.

Although the prior art has disclosed golf club head components composed of magnesium and magnesium alloys, the prior art has failed to disclose a plated magnesium alloy golf club head component.

SUMMARY OF INVENTION

The present invention is a method for plating a component of a golf club head. One aspect of the method of the present invention begins with exposing a component for a golf club head to an alkaline solution. Next, the component is electroless plated with a nickel or nickel-alloy based material to create a component having a first plating layer. The first plating layer has a thickness ranging from 0.0004 inch to 0.001 inch. Next, the component with the first plating layer is electroless plated with a nickel alloy based material to a create a plated component having a second plating layer. The second plating layer has a thickness ranging from 0.0004 inch to 0.001 inch. Next, the plated component with the second plating layer is heated at a temperature ranging from 400° F. to 550° F. for a time period ranging from 60 minutes to 180 minutes.

Another aspect of the method of the present invention begins with exposing a component for a golf club head to an alkaline solution having a pH of 8 to 15. Next, the component is etched with an acidic solution consisting of a sulfuric acid or a chromic acid. Next, the component is exposed to a bi-fluoride activator solution. Next, the component is electroless plated with a nickel or nickel-alloy based material to create a component having a first plating layer. The first plating layer has a thickness ranging from 0.0005 inch to 0.001 inch. Next, the component with the first plating layer is electroless plated with a nickel alloy based material to create a plated component having a second plating layer. The second plating layer has a thickness ranging from 0.0005 inch to 0.001 inch. Next, a chrome or chromate layer is deposited on the component with the second plating layer to create a plated component with a chromium layer. The chrome or chromate layer has a thickness ranging from 0.00001 inch to 0.00002 inch. Next, the plated component with a chromium layer is heated at a temperature ranging from 400° F. to 550° F. for a time period ranging from 60 minutes to 180 minutes.

Yet another aspect of the method of the present invention begins with exposing a component for a golf club head to an alkaline solution having a pH of 12 to 14. Next, the component is etched with an acidic solution consisting of a chromic acid. Next, the component is exposed to a bi-fluoride activator solution. Next, the component is electroless plated with a nickel or nickel-alloy based material to create a component having a first plating layer. The first plating layer has a thickness ranging from 0.0004 inch to 0.001 inch. Next, the component with the first plating layer is electroless plated with a nickel alloy based material to create a plated component having a second plating layer. The second plating layer has a thickness ranging from 0.0004 inch to 0.001 inch. Next, the component with the second plating layer is heated at a temperature ranging from 400° F. to 550° F. for a time period ranging from 60 minutes to 180 minutes. Next, a chrome layer is deposited on the component with a second plating layer to create a plated component with a chromium layer. The chrome layer has a thickness ranging from 0.00001 inch to 0.00002 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
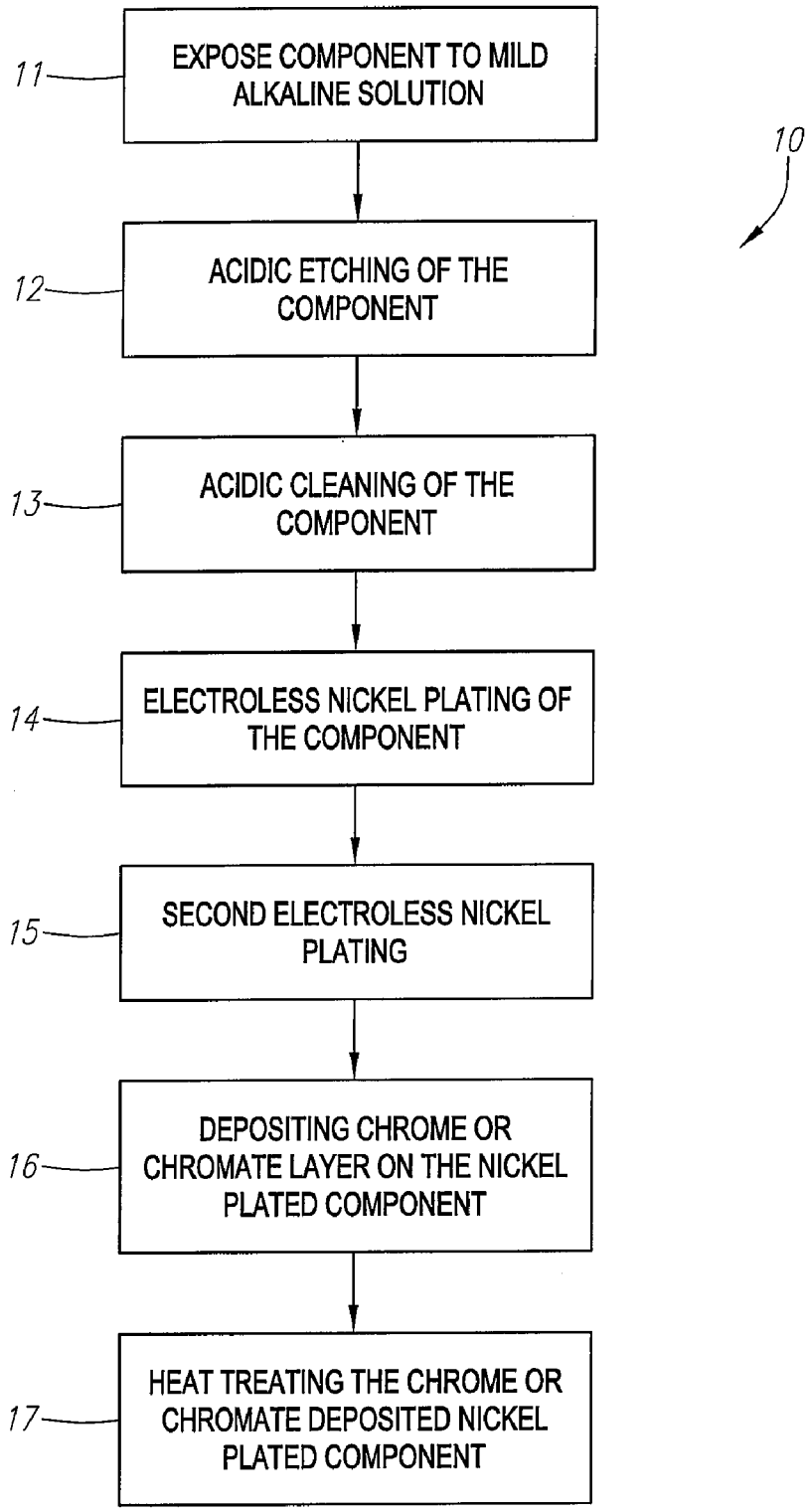
FIG. 1 is a flow chart of a general method for plating a component for a golf club head.

A general method 10 of nickel plating a component for a golf club head is illustrated in FIG. 1. The component, as described in greater detail below, is preferably a sole component for a golf club head. Alternatively, the component is only a portion of the sole of a golf club head. Alternatively, the component is a sole section and a crown section, or an entire club head except a striking plate. Yet further, the component is the entire golf club head. In a most preferred embodiment, the component is composed of a magnesium or magnesium alloy material. Alternatively, the component is composed of a aluminum or aluminum alloy material. Yet further, the component is composed of a material requiring additional plating for increased durability and appearance.

The method 10 preferably begins at block 11 with exposing the component to an alkaline solution with a pH of preferably 10 to 15, with a temperature ranging from 140° F. to 175° F. (most preferably 160° F.), and for a period of preferably five to ten minutes. Preferably the component is placed within a bath of the alkaline solution. Alternatively, the component is soaked with the alkaline solution using a sprayer. Those skilled in the pertinent art will recognize other means of exposing the component to the alkaline solution without departing from the scope and spirit of the present invention. Exemplary alkaline solutions include ammonia and sodium hydroxide (NaOH).

The component may be rinsed in water at an ambient temperature for one to two minutes, and then at block 12 subjected to an acidic etching. The component is preferably exposed to an acid solution for a period of one to two minutes at an ambient temperature. Preferably the component is placed within a bath of the acidic solution. Alternatively, the component is soaked with the acidic solution using a sprayer. Those skilled in the pertinent art will recognize other means of exposing the component to the acidic solution without departing from the scope and spirit of the present invention. Exemplary acidic solutions include chromic and sulfuric acids.

The component may be rinsed in water at an ambient temperature for one to two minutes, and then at block 13 subjected to an acidic cleaning. The component is preferably exposed to an acid solution for a period of one to two minutes, preferably at a temperature ranging from 110° F. to 130° F. (most preferably 120° F.). Preferably the component is placed within a bath of the acidic solution. Alternatively, the component is soaked with the acidic solution using a sprayer. Those skilled in the pertinent art will recognize other means of exposing the component to the acidic solution without departing from the scope and spirit of the present invention. Exemplary acidic solutions include ammonium fluoride.

The component may be rinsed in water at an ambient temperature for one to two minutes, and then at block 14 subjected to electroless nickel plating. Preferably, a MAGENTA electroless nickel plating is plated on the component at a temperature of approximately 100° F. for a period of fifteen to twenty minutes. Preferably, a first plating layer composed of the MAGENTA electroless nickel plating has a thickness of 0.0002 inch to 0.001 inch, and most preferably a thickness of 0.0006 inch, and is plated on the component.

The component may be rinsed in de-ionized water at an ambient temperature for one to two minutes, and then at block 15 subjected to a second electroless nickel plating. Preferably a mid to high phosphorous nickel alloy is plated over the first plating layer of the component at a temperature of approximately 120° F. for a period of twenty to twenty-five minutes. Preferably, a second plating layer composed of the mid to high phosphorous nickel alloy has a thickness of 0.0002 inch to 0.0015 inch, and most preferably a thickness of 0.0006 inch to 0.001 inch.

The component may be rinsed in water at an ambient temperature for one to two minutes, and then at block 16 subjected to a chrome or chromate deposition. The chrome or chromate is deposited over the second plating layer of the component. Preferably, the chrome or chromate deposit layer has a thickness of 0.00001 inch to 0.00002 inch.

The component may be rinsed in water at an ambient temperature for one to two minutes, and then at block 17 subjected to heat treatment. The component with first and second nickel plating layers and a chrome or chromate deposit layer is preferably heat treated at a temperature ranging from 400° F. to 500° F. for a period preferably ranging from ninety minutes to one hundred fifty minutes.

Figure 2:
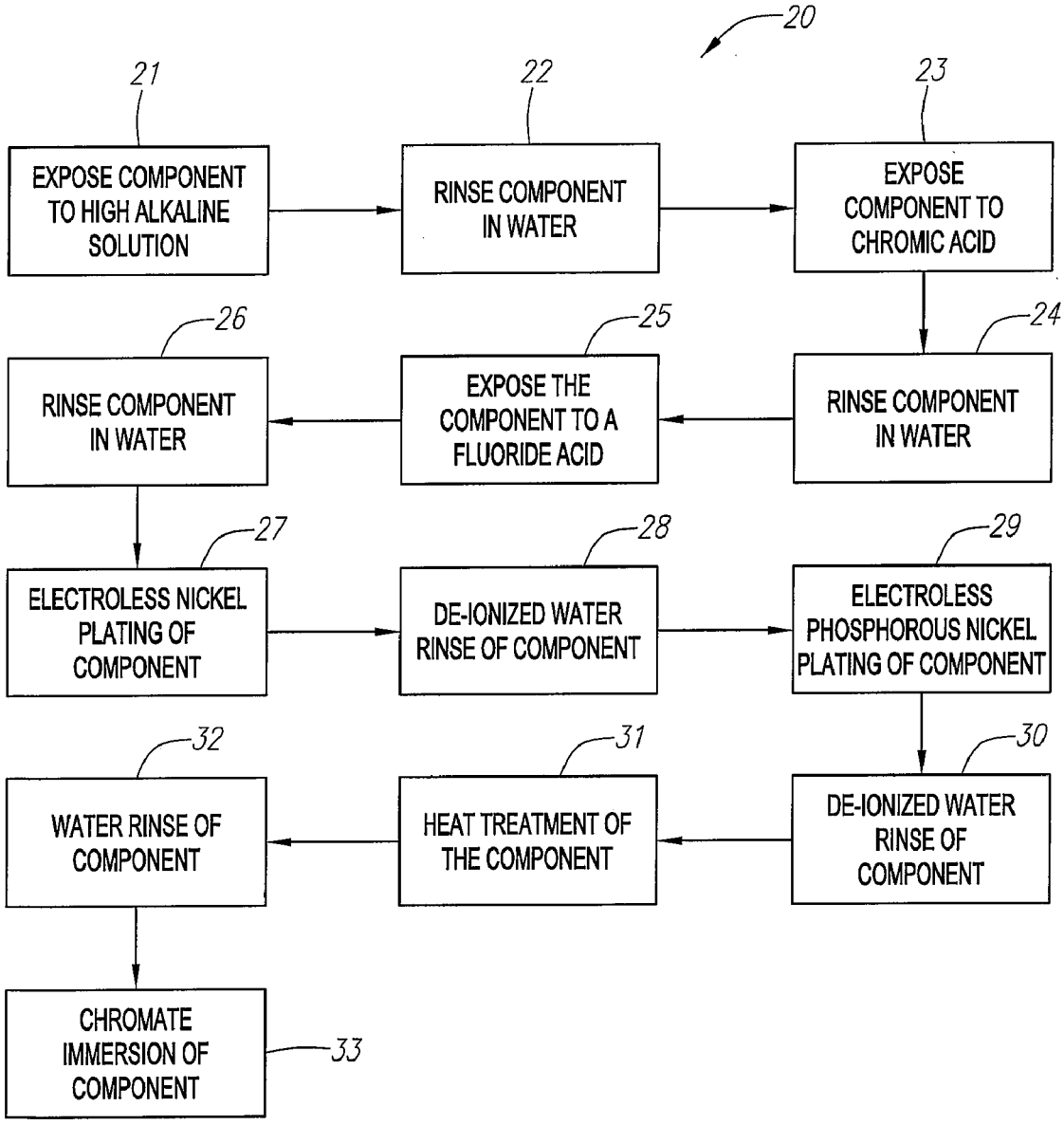
FIG. 2 is a flow chart of a specific method for plating a component for a golf club head.
Figure 3:
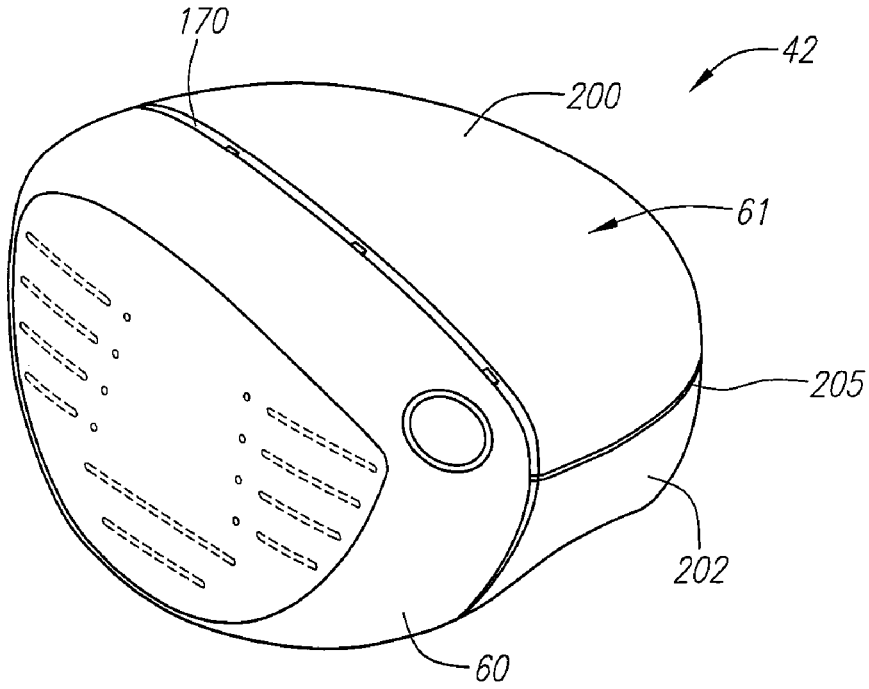
FIG. 3 is a top perspective view of a golf club head.
Figure 4:
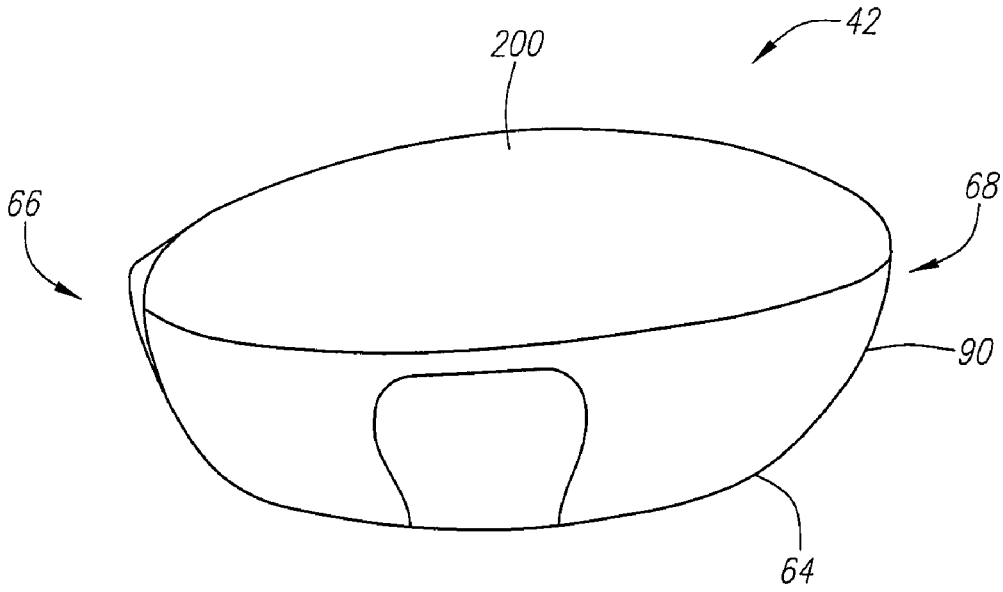
FIG. 4 is rear view of the golf club head of FIG. 2.
Figure 5:
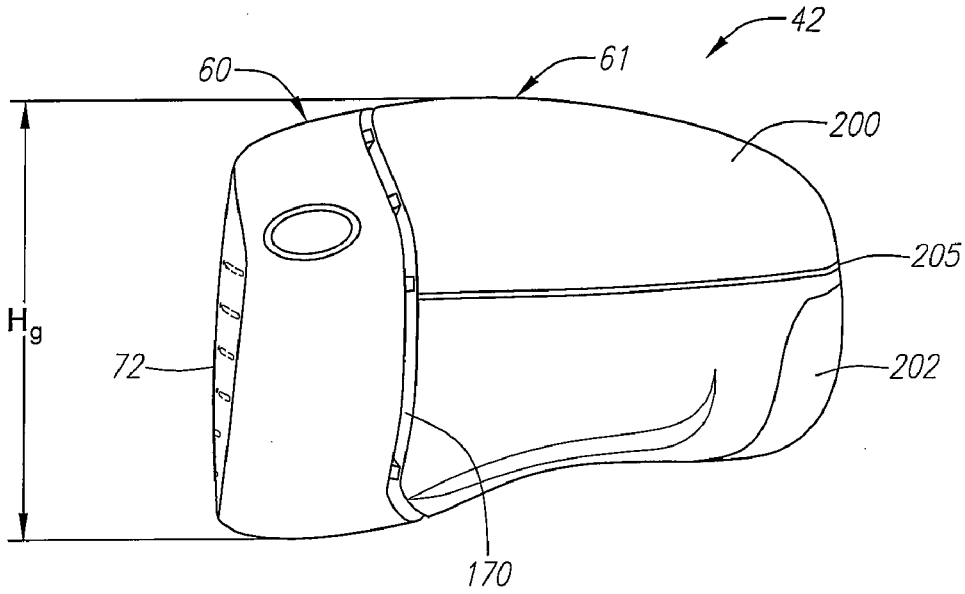
FIG. 5 is a heel side plan view of the golf club head of FIG. 2.

A more specific method 20 of nickel plating a component for a golf club head is illustrated in FIG. 2. The component is as set forth above. The method 20 preferably begins at block 21 with exposing the component to a high alkaline solution with a pH of preferably 12 to 14, with a temperature ranging from 140° F. to 175° F. (most preferably 160° F.), and for a period of preferably five to ten minutes. Preferably the component is placed within a bath of the alkaline solution. Alternatively, the component is soaked with the alkaline solution using a sprayer. Those skilled in the pertinent art will recognize other means of exposing the component to the alkaline solution without departing from the scope and spirit of the present invention. Exemplary alkaline solutions include ammonia and sodium hydroxide (NaOH).

At block 22, the component is rinsed in water at an ambient temperature for one to two minutes. At block 23, the component is subjected to a chromic acid solution. The component is preferably exposed to the chromic acid solution for a period of one to two minutes at a temperature ranging from 70° F. to 90° F. Preferably the component is placed within a bath of the chromic acid solution. Alternatively, the component is soaked with the chromic acid solution using a sprayer. Those skilled in the pertinent art will recognize other means of exposing the component to the chromic acid solution without departing from the scope and spirit of the present invention.

At block 24, the component is rinsed in water at an ambient temperature for one to two minutes. At block 25, the component subjected to a mild acid to reduce or prevent oxidation of the component material, especially if the material is composed of magnesium or a magnesium alloy. The component is preferably exposed to an acid solution for a period of one to two minutes, preferably at a temperature ranging from 70° F. to 90° F. Preferably the component is placed within a bath of the acidic solution. Alternatively, the component is soaked with the acidic solution using a sprayer. Those skilled in the pertinent art will recognize other means of exposing the component to the acidic solution without departing from the scope and spirit of the present invention. Exemplary acidic solutions include sodium fluoride ($NaHF_2$), ammonium fluoride ($NH_4HF_2$) and potassium fluoride ($KHF_2$).

At block 26, the component is rinsed in water at an ambient temperature for one to two minutes. At block 27, the component is subjected to electroless nickel plating. Preferably, a MAGENTA electroless nickel plating is plated on the component at a temperature of approximately 100° F. for a period of twenty to fifty minutes (most preferably forty minutes), and at a pH of 6.0 to 6.5. The MAGENTA electroless plating is available from ARTISTIC PLATING of Anaheim, Calif. Preferably, a first plating layer composed of the MAGENTA electroless nickel plating has a thickness of 0.0002 inch to 0.001 inch, and most preferably a thickness of 0.0006 inch, and is plated on the component.

At block 28, the component is rinsed in de-ionized water at an ambient temperature for one to two minutes. At block 29, the component with a first plating layer is subjected to a second electroless nickel plating. Preferably a mid (6%–8%) to high (10%–12%) phosphorous nickel alloy is plated over the first plating layer of the component at a temperature of approximately 120° F. for a period of thirty to fifty minutes (most preferably forty minutes) for a mid-phosphorous nickel alloy, and a period of sixty to eighty minutes (most preferably seventy minutes) for a high-phosphorous nickel alloy, and both at a pH of approximately 4. Preferably, the second plating layer composed of the mid to high phosphorous nickel alloy has a thickness of 0.0002 inch to 0.0015 inch, and most preferably a thickness of 0.0006 inch to 0.001 inch.

At block 30, the component is rinsed in de-ionized water at an ambient temperature for one to two minutes. At block 31, the component with first and second plating layers is subjected to heat treatment. The component with first and second nickel plating layers is preferably heat treated at a temperature ranging from 400° F. to 500° F. (most preferably 450° F.) for a period preferably ranging from seventy minutes to one hundred fifty minutes (most preferably ninety minutes).

At block 32, the component is rinsed in water at an ambient temperature for one to two minutes. At block 33, the component with first and second plating layers is subjected to a chromate immersion for one to two minutes at a temperature of approximately 90° F. The chromate is deposited over the second plating layer of the component. Preferably, the chrome or chromate deposit layer has a thickness of 0.00001 inch to 0.00002 inch.

FIGS. 3–7 and 9 illustrate an example of a golf club head that has a component plated using the method of the present invention. The club head 42 is preferably composed of a face component 60 and an aft-body 61. The aft-body is preferably composed of an upper section 200 and a lower section 202, which are joined together to form the aft-body 61. The aft-body 61 preferably has a crown portion 62 and a sole portion 64. The golf club head 42 is preferably has a heel end 66 nearest the shaft 48, a toe end 68 opposite the heel end 66, and a rear end 70 opposite the face component 60.

The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

The face component 60 generally includes a striking plate portion (also referred to herein as a face plate) 72 and a return portion 74 extending laterally inward from the perimeter of the striking plate portion 72.

The aft-body 61 is preferably composed of an upper section 200 and a lower section 202, which are joined together to form the aft-body 61. The aft-body 61 is preferably composed of a low density-metal material, preferably a magnesium alloy, aluminum alloy, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body 61 is preferably manufactured through metal-injection-molding. Alternatively, the aft-body 61 is manufactured through casting, die-casting, forming, machining, powdered metal forming, electro chemical milling, and the like.

In a preferred embodiment, the entire lower section 202 of the aft-body 61 has plating 300. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 64*a* has a similar thickness to the sole portion 64. The lower section 202 preferably comprises the bottom section 91 and a lower portion of the ribbon 90. The bottom section 91 preferably has a medial ridge 220 which extends from the undercut portion 64*a* rearward. A heel convex portion 222 is preferably located on a heel end 66 next to the medial ridge 220 and a toe convex portion 224 is preferably located on a toe end 68 next to the medial ridge 220. An alternative embodiment of the bottom section 91 is disclosed in U.S. Pat. No. 5,480,152, entitled Hollow, Metallic Golf Club Head With Relieved Sole And Dendritic Structures, assigned to Callaway Golf Company, and which pertinent parts are hereby incorporated by reference.

The upper section 200 preferably comprises the crown portion 62 and an upper section of the ribbon 90. The crown portion 62 of the aft-body 61 is generally convex toward the sole 64, and engages the ribbon 90 of sole 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 62*a* has a similar thickness to the crown portion 62. As explained above, the upper section 200 and the lower section 202 are joined together preferably through use of an adhesive. An aft-body gap 205 is preferably created upon joining of the upper section 200 and the lower section 202. The crown undercut portion 62*a* has a plurality of undercut projections 177 extending upward from an exterior surface, and a plurality of gap projections 175 extending outward from the edge 190 of the crown portion 62. The plurality of gap projections 175 maintain the annular gap 170 between the crown portion 62 and the return portion 74.

A portion of the aft-body 61 or the entire aft-body is plated using the method of the present invention to provide greater durability than an un-plated equivalent. Alternatively, the entire golf club head is plated using the method of the present invention. The plating 300 preferably ranges from 0.0002 inch to 0.002 inch, more preferably 0.001 inch. The plating material preferably has a Rockwell C hardness greater than 50, and most preferably 60 to 70 Rockwell C hardness. The first plating layer 302 is preferably composed of a MAGENTA electroless plating.

The second plating layer 303 is preferably a nickel based alloy such as nickel-phosphorus alloy (low (1–3% phosphorus), medium (5–9% phosphorus) and high (10–13% phosphorus). Such alloys are available from MacDermid Incorporated or ATO Tech Incorporated.

Figure 8:
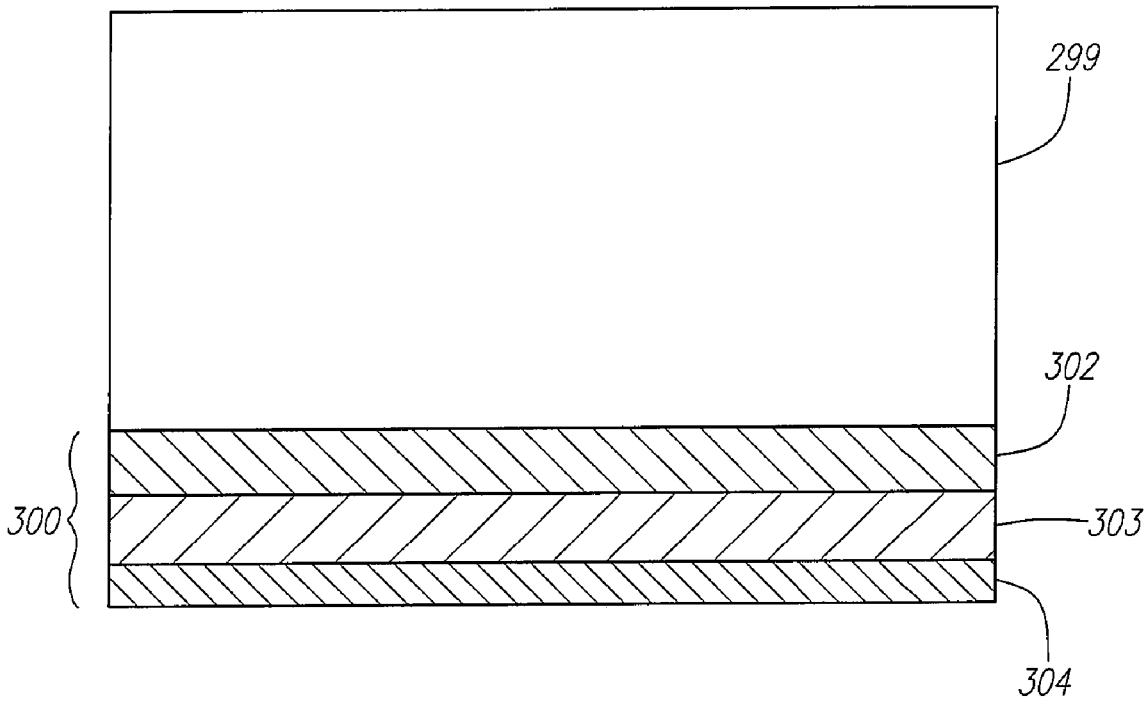
FIG. 8 is a cross-sectional view illustrating the plating on a component of a golf club head.
Figure 9:
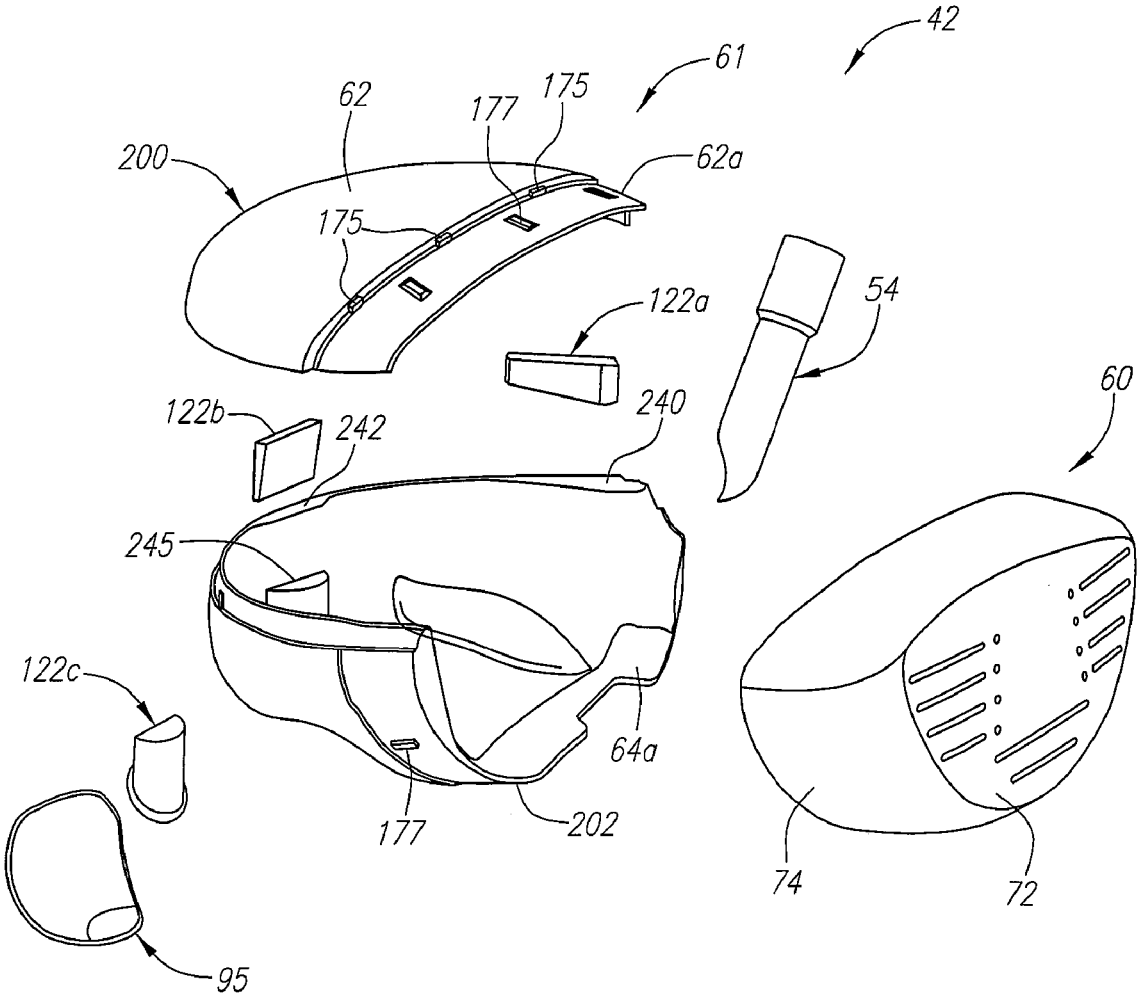
FIG. 9 is an exploded view of a golf club head.

As shown in FIG. 8, the plating 300 includes the first nickel-plating layer 302, the second nickel-plating layer 303, and a chromium or chromate layer 304. The plating 300 is disposed on the surface 299 of the component of the golf club head.

The club head 42 preferably has a greater volume than a club head of the prior art while maintaining a weight that is substantially equivalent to that of the prior art. The volume of the club head 42 of the present invention ranges from 290 cubic centimeters to 600 cubic centimeters, and more preferably ranges from 330 cubic centimeters to 510 cubic centimeters, even preferably 350 cubic centimeters to 465 cubic centimeters, and most preferably 385 cubic centimeters or 415 cubic centimeters.

The mass of the club head 42 preferably ranges from 150 grams to 300 grams, more preferably ranges from 175 grams to 250 grams, and yet more preferably ranges from 180 grams to 225 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting members 122*a*, 122*b* and 122*c* have a combined mass preferably ranging from 30 grams to 120 grams, more preferably from 50 grams to 80 grams, and most preferably 60 grams. The plating 300 preferably has a mass ranging from 0.5 grams to 5 grams, more preferably from 1.0 grams to 3.0 grams, and most preferably 2.5 grams. Additionally, epoxy, or other like flowable materials, in an amount ranging from 0.5 grams to 5 grams, may be injected into the hollow interior 46 of the golf club head 42 for selective weighting thereof.

Figure 6:
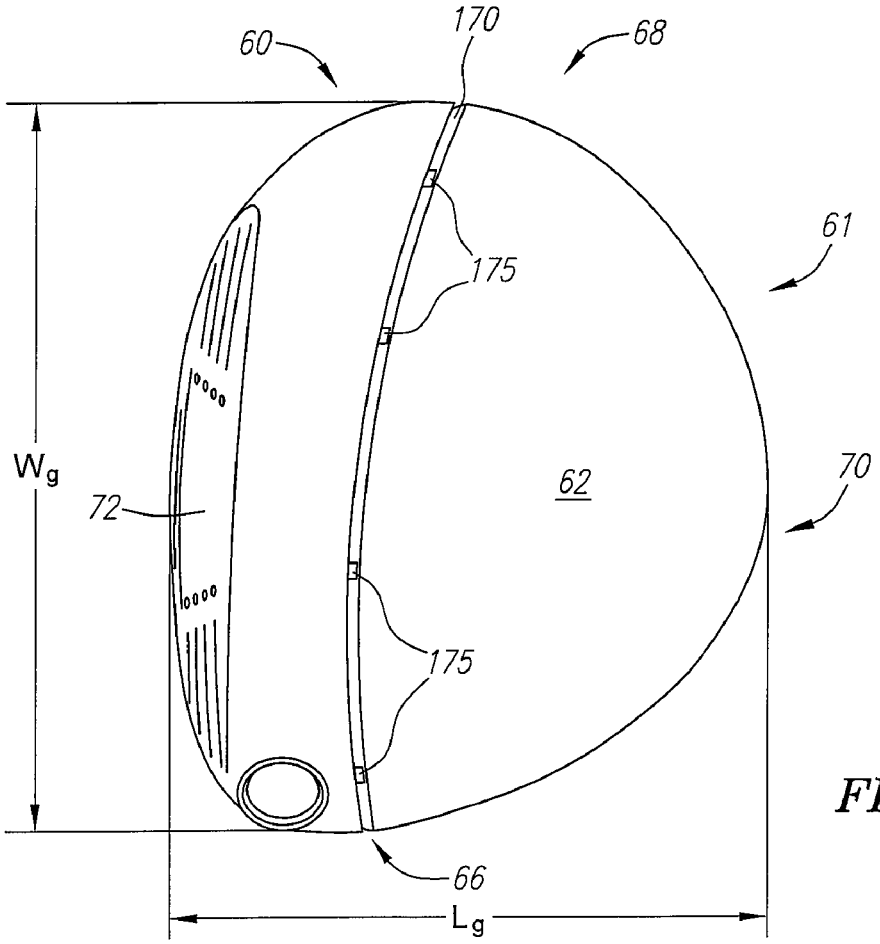
FIG. 6 is a top plan view of the golf club head of FIG. 2.
Figure 7:
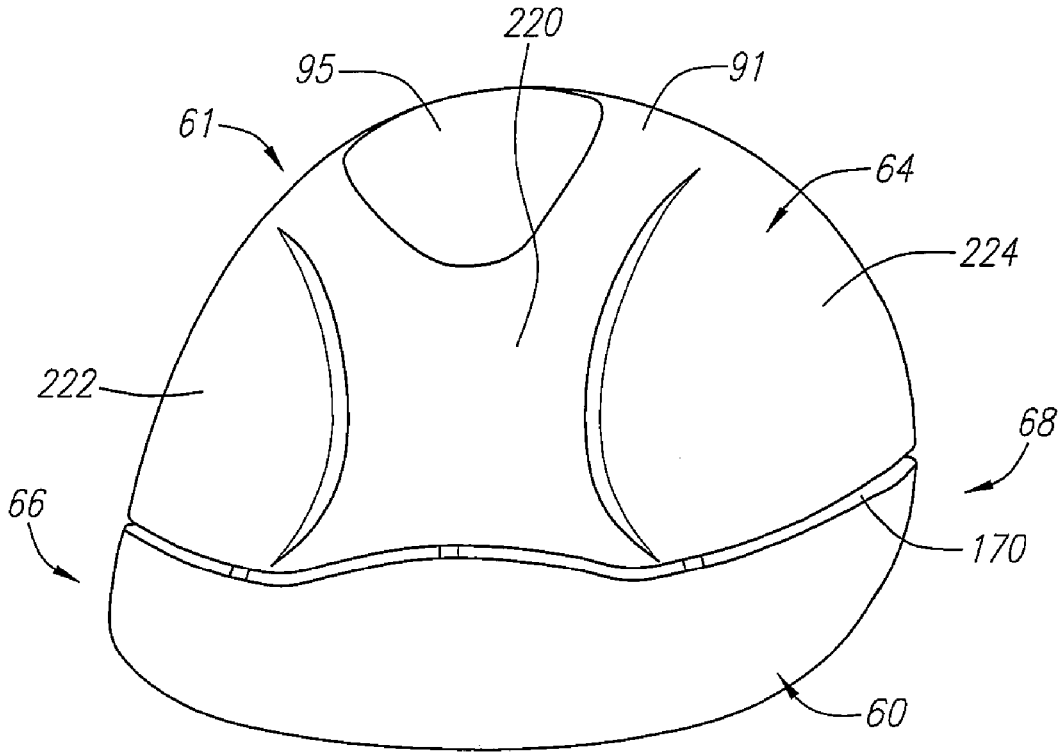
FIG. 7 is a bottom view of the golf club head of FIG. 2.

As shown in FIG. 6, the length, "Lg", of the club head 42 from the striking plate portion 72 to the rear section of the crown portion 62 preferably ranges from 3.0 inches to 4.5 inches, and is most preferably 3.5 inches. As shown in FIG. 6, the height, "Hg", of the club head 42, as measured while in striking position, preferably ranges from 2.0 inches to 3.5 inches, and is most preferably 2.50 inches. As shown in FIG. 6, the width, "Wg", of the club head 42 from the toe section 68 to the heel section 66 preferably ranges from 4.0 inches to 5.0 inches, and more preferably 4.4 inches.

Figure 10:
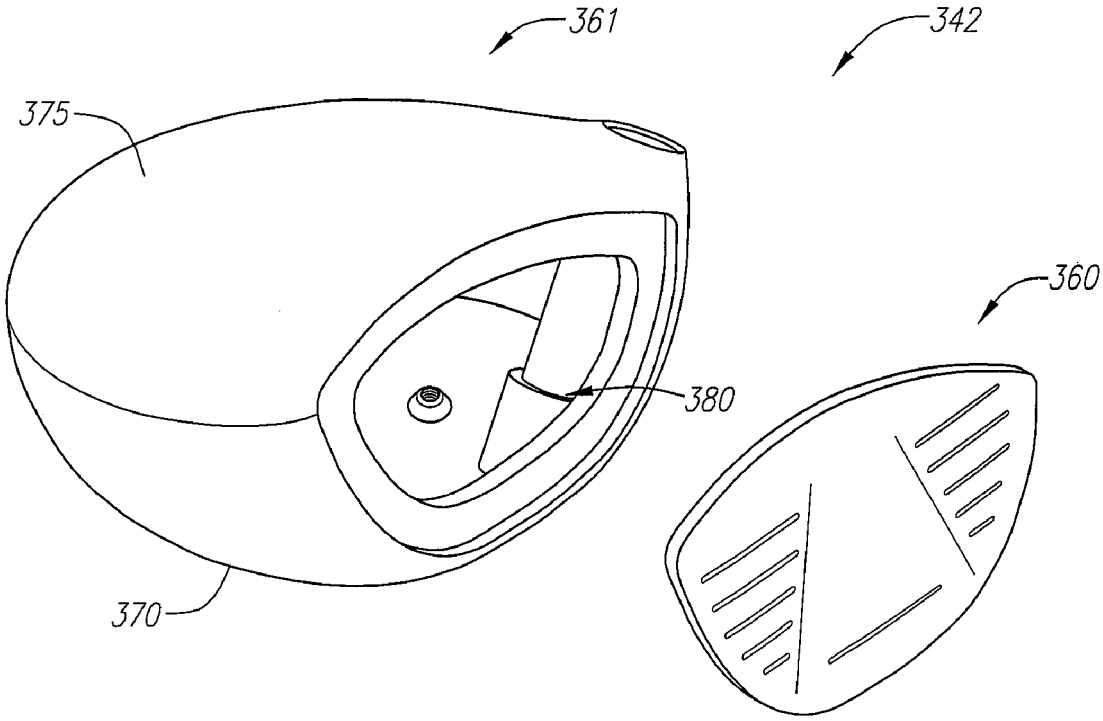
FIG. 10 is a top exploded perspective view of a golf club head.

FIG. 10 illustrates an alternative embodiment of a golf club head 342 having a plated portion. The golf club head 342 has a striking plate 360 and an aft-body 361. The aft-body 361 comprises a sole section 370 and a crown section 375. The striking plate 360 is preferably composed of a titanium alloy, titanium, amorphous metal (as described above) stainless steel or other steel alloy. The aft-body 361 is preferably composed of a low density-metal material, preferably a magnesium alloy, aluminum alloy, magnesium or aluminum material, such as described above, which also has a plating 300 (as described above) on a portion of the aft-body 361. The striking plate 360 is positioned over an opening 380 in the aft-body 361, and attached to the aft-body 361 through well-known methods such as press-fitting, brazing and the like. In one embodiment, the sole section 370 has a plating 300. In another embedment, the sole section 370 and the crown section 375 both have plating 300. The golf club head 342 preferably has similar volumes, CORs, moments of inertia, mass and products of inertia as described above in reference to the golf club head 42.

Figure 11:
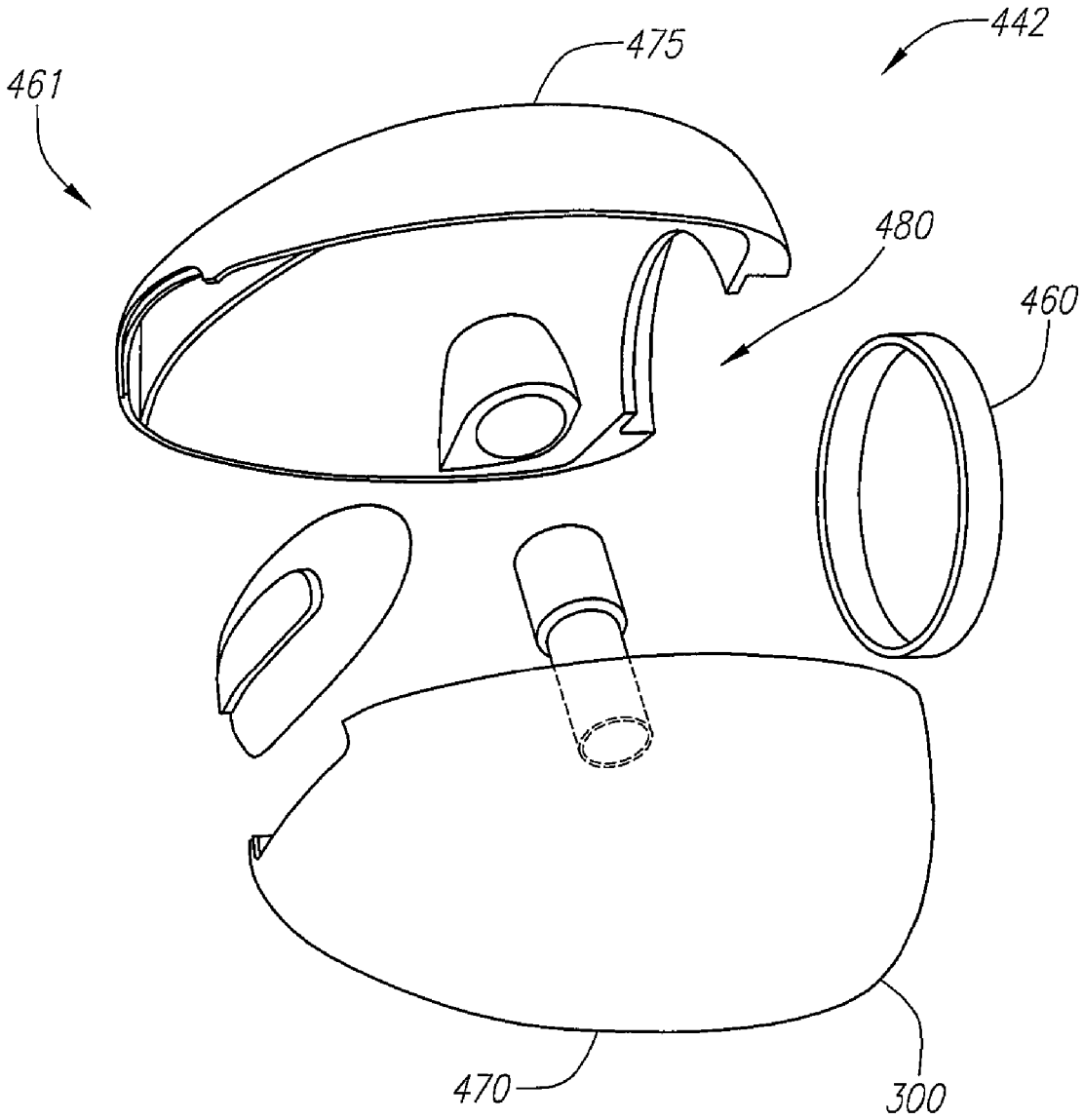
FIG. 11 is a bottom exploded perspective view of a golf club head.

FIG. 11 illustrates an alternative embodiment of a golf club head 442 having a plated portion. The golf club head 442 has a striking plate 460 and an aft-body 461 with a sole section 470 and a crown section 475. The striking plate 460 is preferably composed of a titanium alloy, titanium, amorphous metal (as described above) stainless steel or other steel alloy. The aft-body 461 is preferably composed of a low density-metal material, preferably a magnesium alloy, aluminum alloy, magnesium or aluminum material, such as described above, which also has a plating layer 300 (as described above) on a portion of the aft-body 461. The striking plate 460 is positioned over an opening 480 in the aft-body 461, and attached to the aft-body 461 through well-known methods such as press-fitting, brazing and the like. In one embodiment, the sole section 470 has a plating 300. In another embedment, the sole section 470 and the crown section 475 both have plating 300. The golf club head 442 preferably has similar volumes, CORs, moments of inertia, mass and products of inertia as described above in reference to the golf club head 42.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for plating a component for a golf club head, the method comprising:

exposing a component for a golf club head to an alkaline solution, the component composed of a magnesium alloy material or magnesium, the alkaline solution having a pH of 8 to 15;

etching the component for a golf club head with an acidic solution consisting of a sulfuric acid or a chromic acid;

exposing the component to a bi-fluoride activator solution; electroless plating a nickel or nickel-alloy based material on the component for a golf club head to create a component having a first plating layer having a thickness ranging from 0.0005 inch to 0.001 inch; electroless plating a nickel alloy based material on the component with a first plating layer to a create a component having a second plating layer having a thickness ranging from 0.0005 inch to 0.001 inch; depositing a chrome or chromate layer on the component with a second plated layer to create a plated component with a chromium layer, the chrome or chromate layer having a thickness ranging from 0.00001 inch to 0.00002 inch; and heating the plated component with a chromium layer at a temperature ranging from 400° F. to 550° F. for a time period ranging from 60 minutes to 180 minutes.

2. The method according to claim 1 wherein the bi-fluoride is an ammonium fluoride.

3. The method according to claim 1 the alkaline solution has a temperature ranging from 120° F. to 200° F.

4. The method according to claim 1 wherein the bi-fluoride activator solution has a temperature ranging from 120° F. to 200° F.

5. The method according to claim 4 wherein the component for a golf club head is exposed to the bi-fluoride activator solution for a period of five to ten minutes.

6. The method according to claim 1 wherein the electroless plating of the component for a golf club head is performed at a temperature ranging from 80° F. to 110° F.

7. The method according to claim 1 wherein the component of the golf club head is a sole section.

8. The method according to claim 1 wherein the component of the golf club head is an aft-body.

9. The method according to claim 1 wherein the component of the golf club head is the entire golf club head.

10. A method for plating a component for a golf club head, the method comprising:

exposing a component for a golf club head to an alkaline solution, the component composed of a magnesium alloy material or magnesium, the alkaline solution having a pH of 12 to 14;

etching the component for a golf club head with an acidic solution consisting of a chromic acid;

exposing the component to a bi-fluoride activator solution; electroless plating a nickel or nickel-alloy based material on the component for a golf club head to create a component having a first plating layer, the first plating layer having a thickness ranging from 0.0004 inch to 0.001 inch; electroless plating a nickel alloy based material on the component having a first plating layer to a create a component having a second plating layer, the second plating layer having a thickness ranging from 0.0004 inch to 0.001 inch;

heating the component with a second plating layer at a temperature ranging from 400° F. to 550° F. for a time period ranging from 60 minutes to 180 minutes; and depositing a chrome layer on the component with a second plating layer to create a plated component with a chromium layer, the chrome layer having a thickness ranging from 0.00001 inch to 0.00002 inch.

11. The method according to claim 10 wherein the bi-fluoride is selected from the group consisting of ammonium fluoride, potassium fluoride and sodium fluoride.

12. The method according to claim 10 the alkaline solution has a temperature ranging from 120° F. to 200° F.

13. The method according to claim 10 wherein the bi-fluoride activator solution has a temperature ranging from 60° F. to 100° F.

14. The method according to claim 13 wherein the component for a golf club head is exposed to the bi-fluoride activator solution for a period of one to two minutes.

15. The method according to claim 10 wherein the electroless plating of the component for a golf club head is performed at a temperature ranging from 80° F. to 110° F.

16. The method according to claim 10 wherein the component of the golf club head is a sole section.

17. The method according to claim 10 wherein the component of the golf club head is an aft-body.

18. The method according to claim 10 wherein the component of the golf club head is to entire golf club head.

* * * * *